US007763815B2

(12) United States Patent
Luong

(10) Patent No.: US 7,763,815 B2
(45) Date of Patent: Jul. 27, 2010

(54) KEY FOR AN ELECTRONIC KEYBOARD

(75) Inventor: Ngoc Minh Luong, Selden, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 879 days.

(21) Appl. No.: 11/557,127

(22) Filed: Nov. 7, 2006

(65) Prior Publication Data

US 2008/0105528 A1 May 8, 2008

(51) Int. Cl.
*H01H 1/06* (2006.01)

(52) U.S. Cl. ..... 200/275; 200/16 A; 200/16 D; 200/512

(58) Field of Classification Search ..... 200/16 R–16 D, 200/511, 512, 517, 239, 275, 292, 341
See application file for complete search history.

(56) References Cited

U.S. PATENT DOCUMENTS 5,810,604 A * 9/1998 Kopp et al. ..... 434/317
5,952,629 A * 9/1999 Yoshinaga et al. ..... 200/5 A
6,448,518 B1 * 9/2002 Martin et al. ..... 200/292
6,573,467 B1 * 6/2003 Nakanishi et al. ..... 200/406
6,603,086 B2 * 8/2003 Kawaguchi et al. ..... 200/517
7,030,329 B1 * 4/2006 Sneek et al. ..... 200/292
7,090,374 B2 * 8/2006 Arthur ..... 362/205
7,304,256 B2 * 12/2007 Kawahira et al. ..... 200/85 A
7,439,465 B2 * 10/2008 Parkinson ..... 200/512
7,528,338 B2 * 5/2009 Ataka ..... 200/517

* cited by examiner

*Primary Examiner*—Michael A Friedhofer
(74) *Attorney, Agent, or Firm*—Thorne & Halajian, LLP

(57) ABSTRACT

A conductive tracing for a keyboard including a pair of electrically conductive paths that are electrically isolated from each other. The pair of electrically conductive paths may each include conductive surfaces that are electrically coupled together. Each of the plurality of conductive surfaces of the pair of electrically conductive paths extend radially between a center portion and a peripheral portion of the conductive tracing. One or more of the conductive surfaces may include a pair of outer edges that are substantially parallel to a respective radial direction that the outer edges extend in. The conductive surfaces of one of the pair of electrically conductive paths may be complementary formed to the conductive surfaces of another of the pair of electrically conductive paths. The conductive tracing may be substantially symmetric about an axis that passes through the center portion of the conductive tracing.

24 Claims, 4 Drawing Sheets

KEY FOR AN ELECTRONIC KEYBOARD

FIELD OF THE INVENTION

The present system relates to electronic keyboard systems and more particularly to electronic keys of electronic keyboard systems.

BACKGROUND OF THE INVENTION

Electronic keyboard systems are known wherein keys are moveably positioned on a given surface such as a surface of a remote control device or computer input keyboard. In operation, depression of a key by a user closes a contact thereby making an electrical connection that uniquely identifies the key that was pressed. The unique identifier is transmitted by wire or wirelessly to a corresponding device that typically performs some action that corresponds to the particular key that was depressed.

In construction, an x-y coordinate grid or matrix of conductive paths is typically deposed on a bottom portion of the keyboard. Positioned above each of the conductive paths is a contact pad. When the key is not depressed, the contact pad is positioned so as not to be in electrical contact with an underlying conductive path. When the key is depressed, the contact pad comes into electrical contact with two ends of an underlying conductive path, thereby closing the circuit and providing the unique identifier determined by the X,Y coordinate of the depressed key as discussed above.

U.S. Pat. No. 4,005,293 ("the '293 Patent") shows such a keyboard and is incorporated herein as if set out in its entirety. The '293 Patent utilizes a circular contact area on the contact pad.

The keys generally operate well when depressed from a center of the key but have problems in that keys may be depressed in numerous ways, such as an off-center depression, which may not result in a proper connection with the underlying grid. In this case, the unique identifier may not toe produced, and therefore, the intended operation of the keyboard may fail.

FIG. 1 shows a prior art solution wherein the conductive paths of the '293 Patent are replaced with a conductive tracing 100 that has a conductive paths 110, 112 with a conductively isolating area 114 in the form of a diminishing sinusoidal wave. It has been found that the conductive tracing 100 performs well in some off-center depressions. However, the conductive tracing 100 still has dead zones as indicated by dashed lines 120. These dead zones are problematic when the key is depressed, for example, in an area along an outside periphery of a corresponding key.

It is an object of the present system to overcome disadvantages and/or make improvements in the prior art.

SUMMARY OF THE INVENTION

The present system comprises a method and device including a key for an electronic keyboard including a contact pad and a conductive tracing underlying the contact pad. In another embodiment, the present system is directed to the conductive tracing. The conductive tracing includes a pair of electrically conductive paths that are electrically isolated from each other. The contact pad includes a conductive surface that makes electrical contact between the pair of electrically conductive paths when the contact pad is depressed.

The pair of electrically conductive paths may each include conductive surfaces that are electrically coupled together. Each of the plurality of conductive surfaces of the pair of electrically conductive paths extend radially between a center portion and a peripheral portion of the conductive tracing. In one embodiment, each of the plurality of conductive surfaces may have a length that substantially extends between corresponding inner and outer concentric circles centered around the center of the conductive tracing.

One or more of the conductive surfaces of the pair of electrically conductive paths may include a pair of outer edges that are substantially parallel to a respective radial direction that the outer edges extend in. In one embodiment, the conductive surfaces of each of the pair of electrically conductive paths are similarly formed as other conductive surfaces of the pair. The conductive surfaces of one of the pair of electrically conductive paths may be complementary formed to the conductive surfaces of another of the pair of electrically conductive paths. The conductive tracing may be substantially symmetric about an axis that passes through the center portion of the conductive tracing and extends in a direction substantially parallel to a surface of the conductive tracing. The conductive surfaces of each of the pair of electrically conductive paths may include three or more conductive surfaces. For example, in one embodiment, each of the conductive tracings may have six conductive surfaces.

BRIEF DESCRIPTION OF THE DRAWINGS

In the accompanying drawings, like reference numbers in different drawings designate similar elements. It should be expressly understood that the drawings are included for illustrative purposes and do not represent the scope of the present system in which.

DETAILED DESCRIPTION OF THE INVENTION

The following are descriptions of illustrative embodiments that when taken in conjunction with the following drawings will demonstrate the above noted features and advantages, as well as further ones. In the following description, for purposes of explanation rather than limitation, specific details are set forth such as architecture, interfaces, techniques, etc. However, it will be apparent to those of ordinary skill in the art that other embodiments that depart from these details would still be understood to be within the scope of the appended claims. Moreover, for the purpose of clarity, detailed descriptions of well-known devices, circuits, and methods are omitted so as not to obscure the description of the present system. In the accompanying drawings, like reference numbers in different drawings may designate similar elements.

Figure 1:
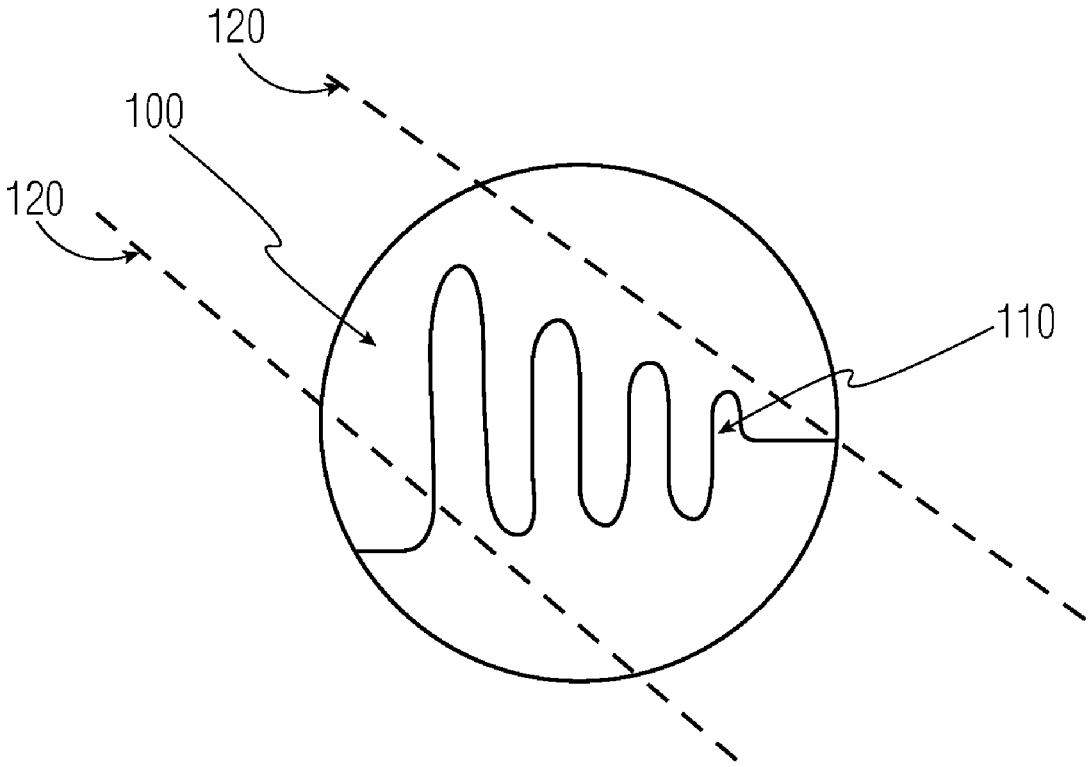
FIG. 1 PRIOR ART
FIG. 1 shows an overhead view of a known conductive tracing.
Figure 2:
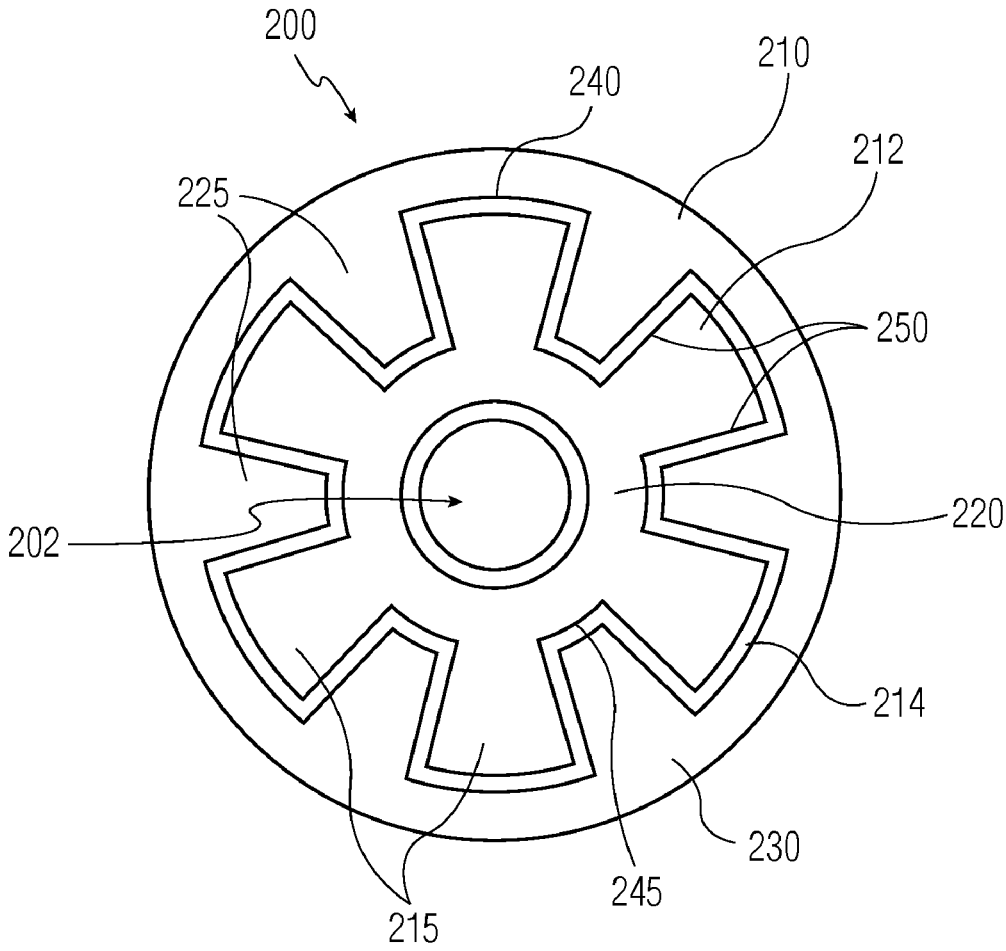
FIG. 2 shows an overhead view of a conductive tracing in accordance with an embodiment of the present invention.

FIG. 2 shows an overhead view of an illustrative conductive tracing 200 in accordance with an embodiment of the present system. The conductive tracing 200 may have a cutout portion 202 towards a center of the of the conductive tracing to enable light generated on an underside to radiate upward towards, for example, a key to provide illumination of the key. The conductive tracing 200 includes electrically conductive paths 210, 212. The electrically conductive paths 210, 212 are formed from one or more electrically conductive materials, such as copper, aluminum, and/or other conductive materials.

The conductive paths 210, 212 are electrically coupled to a device such that depression of an overlying contact pad (discussed further herein below) produces a signal wherein the depression of the overlying contact pad may be discerned, for example as described in the '293 patent. The conductive paths 210, 212 are substantially complementary in shape however, are electrically isolated from each other by an isolating area 214. By the term complementary, what is intended is that as illustratively shown in FIG. 2, adjacent portions of the conductive paths 210, 212 have a similar shape and form. For example, portions of the conductive path 210 may be interleaved with portions of the conductive path 212. The conductive tracing 200 may be formed by photolithography, chemical etching, chemical vapor deposition, printing, pressing and/or any other technique that may be suitably applied as may be appreciated by a person of ordinary skill in the art. The conductive tracing 200 may be formed, on a printed circuit board (PCB) or other suitable surface.

In accordance with an embodiment of the present system, the conductive path 212 includes a plurality of conductive surfaces 215 that are electrically coupled together substantially around a center portion 220 of the tracing 212. The conductive path 210 includes a plurality of conductive surfaces 225 that are electrically coupled together substantially around an outer peripheral portion 230 of the tracing 210. The conductive surfaces 215 radiate outward from the center portion 220 of the conductive tracing 200. The conductive surfaces 225 radiate inward from the outer peripheral portion 230 of the conductive tracing 200. In this embodiment, the conductive surfaces 215 are interleaved with the conductive surfaces 225. In one embodiment, the plurality of conductive surfaces 215 and the plurality of conductive surfaces 225 are three or more conductive surfaces. In a particular embodiment, the plurality of conductive surfaces 215 may be an even number of conductive surfaces, such as two, four, six, eight, etc. conductive surfaces, or an odd number of conductive surfaces, selection of which number to utilize may be at least partly dependent on a selected thickness across the conductive surfaces. For example, in one embodiment there may be six conductive surfaces 215 and six conductive surfaces 225 that are substantially symmetrically positioned around the center portion 220.

The plurality of conductive surfaces 213 may extend in a direction substantially radial outward from the center portion 220. The plurality of conductive surfaces 225 may extend in a direction substantially radial inward from the outer peripheral portion 230 towards the center portion 220. For example, in one embodiment in accordance with the present system, the plurality of conductive surfaces 215 may be formed along a pair of corresponding concentric circles wherein an inner one of the concentric circles is surrounded by an outer one of the concentric circles. Similarly, the plurality of conductive surfaces 225 may be formed along another pair of corresponding concentric circles, wherein an inner one of the other pair of concentric circles is surrounded by an outer one of the other pair of concentric circles.

Each of the plurality of conductive surfaces 215 may have a length radiating outward from the center potion 220 that extends substantially between the corresponding inner and outer ones of the concentric circles. Similarly, the plurality of conductive surfaces 225 may have a length radiating inward from the outer peripheral potion 230 that extends substantially between the other inner and outer ones of the concentric circles. One or more of the plurality of conductive surfaces 215 may be arranged to resemble the form of spokes radiating outward on a wheel wherein exterior edges 240 of the plurality of conductive surfaces 215 may form arcs that are longer in length than arcs formed by interior edges 245 that connect the plurality of conductive surfaces 215. Each spoke so formed may have outside edges 250 that join the exterior edges 240 to corresponding interior edges 245.

The isolating area 214 may have a similar shape as the electrically conductive path 212 and surrounds the electrically conductive path 212. As stated previously, the electrically conductive path 210 has a substantially complementary shape to the electrically conductive path 212.

In another embodiment, the exterior edges 240 may form substantially straight lines that extend perpendicular to the respective radial direction of the corresponding one of the plurality conductive surfaces 215. Adjacent conductive surfaces, each having one adjacent substantially parallel line, may be joined together by one of the interior edges 230. In this embodiment, each of the plurality of conductive surfaces 215 may be similarly formed. The exterior edges 240 of the plurality of conductive surfaces 215 may be located substantially on the outer concentric circle that is centered around the center portion 220. The interior edges 230 of the plurality of conductive surfaces 215 may be located substantially on the inner concentric circle. Each edge of the substantially parallel outside edges 250 may have a substantially equal length. The conductive tracing 212 may be substantially symmetric about an axis that passes through the center portion 220 and extends in a direction substantially parallel to a surface of the contact pad 212.

Figure 3A:
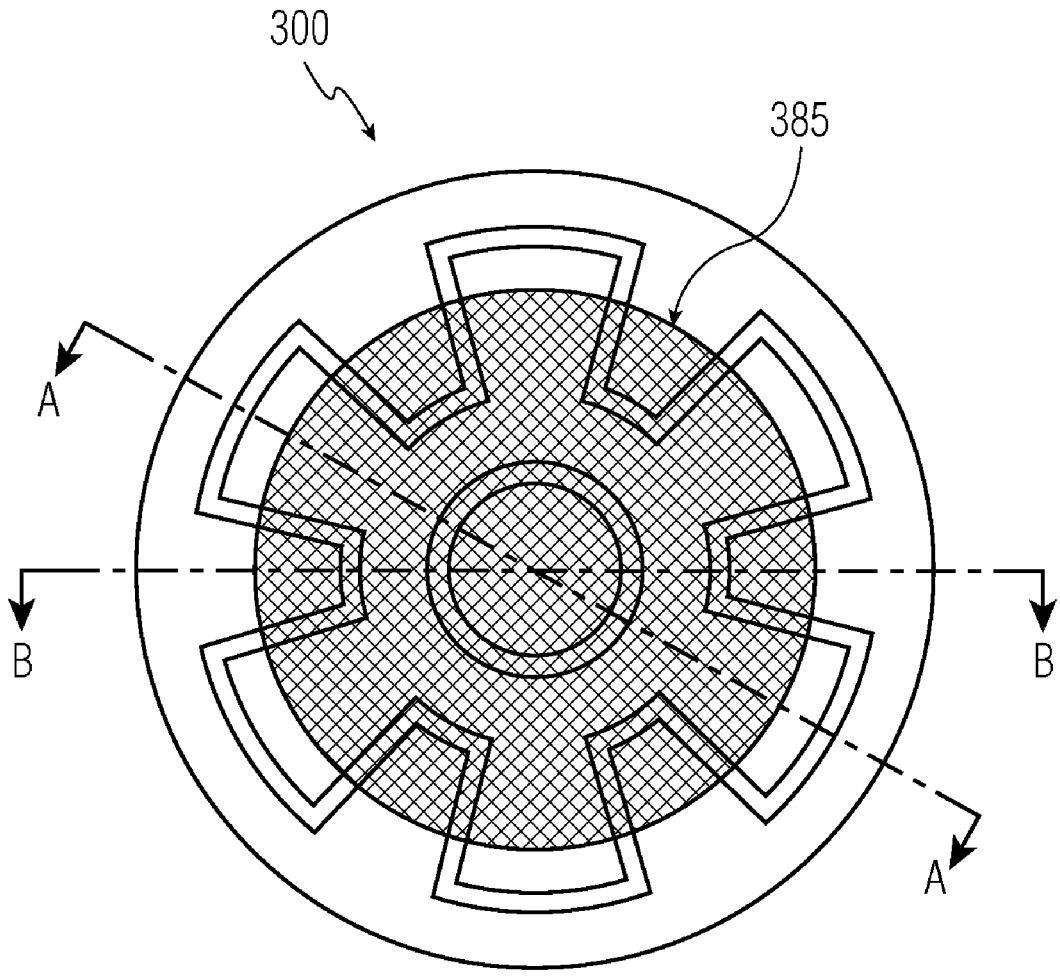
FIG. 3A shows an overhead view of an illustrative conductive tracing in accordance with an embodiment of the present system.

FIG. 3A shows an illustrative conductive tracing 300 in accordance with an embodiment of the present system that is similar in form as the conductive tracing 200 shown in FIG. 2. The conductive tracing 300 has sectional indications A-A and B-B. A conductive portion 385 of a contact pad is illustratively shown overlaying the conductive tracing 300. Naturally, other positionings of the conductive portion 385 with relation to the conductive tracing 300 may be suitably applied. As may be readily appreciated by a person of ordinary skill in the art and as described further herein, the conductive portion 385 typically is not in electrical contact with the conductive tracing 300 until a downward force is exerted on the contact pad.

Figure 3B:
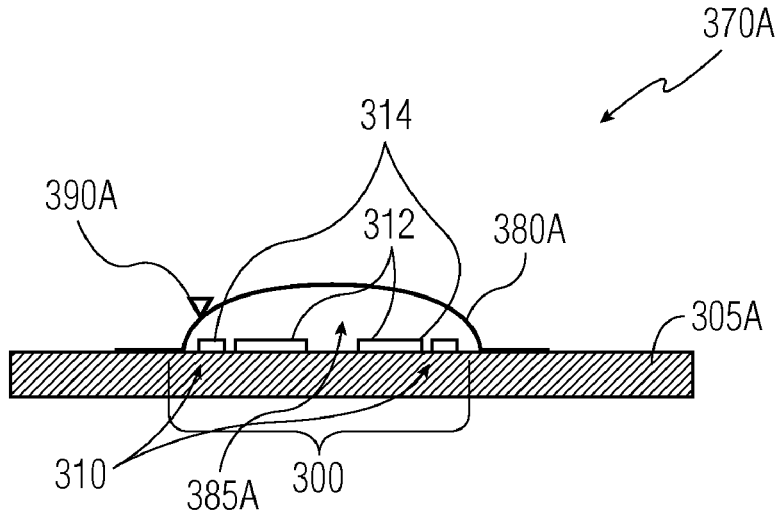
FIGS. 3B and 3C show a side view of an illustrative key in accordance with an embodiment of the present system.

FIG. 3B shows an illustrative cross sectional view of a key 370A for an electronic keyboard in accordance with an embodiment of the present system. The terms key and keyboard as used herein is intended to encompass a system for enabling an input selection by a user for a device. The key 370A may form all or a portion of the keyboard. The key 370A may be integrally manufactured as a part of the device, such as a key on an electronic device, such as a television, personal digital assistant or other portable computer. In another embodiment, the key 370A may be one of a plurality of keys that operates for user input yet is manufactured in an enclosure that is separate from the device. Such a separate key is present on a QWERTY keyboard, which is operationally coupled to a device, such as a desktop computer, but is not necessarily integrated into the device.

The key 370A may also be a key of a remote control device that is operationally coupled to a controlled device, such as a television and corresponding television remote control. Other uses of the key 370A in accordance with the present system would readily occur to a person of ordinary skill in the art. To simplify the following discussion, the term keyboard will be utilized herein but is intended to encompass the above and other applications where an input device, namely the key 370A of a keyboard, may be suitably utilized.

FIG. 3B further shows the key 370A including a contact pad 380A and the conductive tracing 300 positioned on a surface 305A, such as a PCB. The contact pad, for example formed as a membrane, is illustratively shown extending to the surface 305A. The conductive tracing 300 is illustratively depicted along the sectional indication A-A shown in FIG. 3A. The conductive tracing 300 is positioned with reference to the key 370A to illustrate operation in accordance with an embodiment of the present system. The contact pad 380A has a conductive surface 385A that is positioned on an underside of the contact pad facing the conductive tracing 300. The conductive surface 385A may only cover a portion of an underside of the contact pad 380A, but is sufficiently sized for operation as described herein. The contact pad 380A may be formed of a flexibly resilient material such that when no downward force is applied to the contact pad 380A, the conductive surface 385A is not electrically coupled to either of conductive paths 310, 312. In another embodiment, when no downward force is applied to the contact pad 380A, the conductive surface 385 may be electrically coupled to one or another of the conductive paths 310, 312 but is not electrically coupled to both of the conductive paths 310, 312.

The conductive paths 310, 312 are electrically isolated from each other by an isolating area 314 when no downward force is applied to the contact pad 380A. In typical operation, a downward force 390 is applied to the contact pad 380A when a user wishes, for example, to make an indication through the keyboard by the key 370A. The downward force 390 is illustratively shown as acting on a periphery of the contact pad 380A as may occur if the user applies a downward force on an outside edge of the key 370A. The downward force 390 operates to deform the contact pad 380A such that the conductive surface 385A is brought into electrical contact with the conductive paths 310, 312. In this way, the conductive surface 385A electrically couples the conductive paths 310, 312 and thereby, the user desired indication may be reliably provided in spite of the peripheral key press.

Figure 3C:
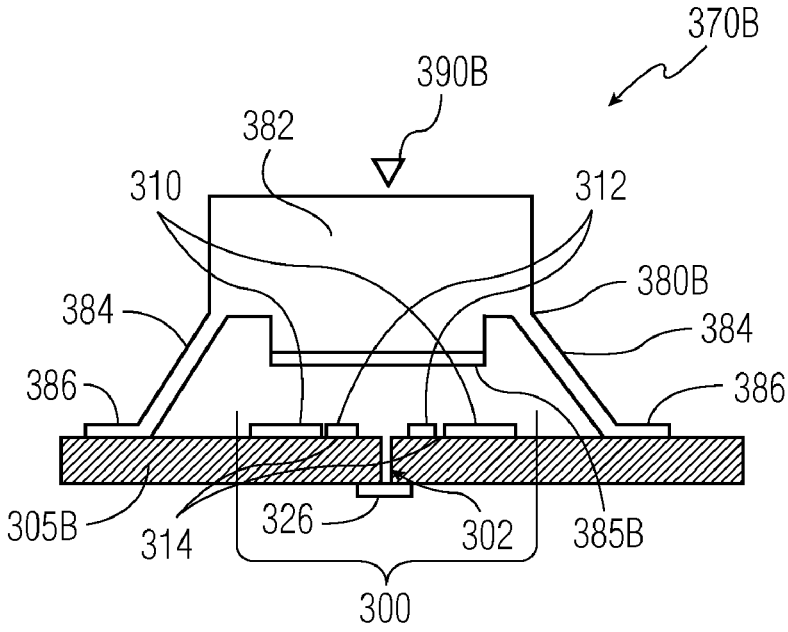

FIG. 3C further shows a key 370B including the conductive tracing 300 illustratively depicted along the sectional indication B-B shown in FIG. 3A and a contact pad 380B. The contact pad 380B is illustratively shown including a portion 382, leg portions 384, foot portions 386 and a conductive surface 385B. The portion 382 may be formed from a rigid material, such as silicon. The leg portions 334 may be formed of a flexible resilient material, such as rubber. The leg portions 384 retain the conductive surface 385B electrically isolated from the conductive tracing 300 in the absence of a downward force being applied to the portion 382 as may be readily appreciated. The foot portions 386 may be affixed to a PCB 305B of the conductive tracing 300. In an alternate embodiment, the key 380B is positionally retained above the conductive tracing 300 without affixing the foot portions 306. The conductive surface 385B is affixed to the portion 382, such as by molding, printing, and/or other operations that may be suitably applied.

The PCB 305 may have a cutout portion 302 positioned under the key 380B. Further, a light source 326, such as a light emitting diode (LED), incandescent bulb, etc., may be positioned at an underside of the PCB 305B. The cutout 302 is positioned with relation to the light source 326, such that a light path is formed. In this way, the light generated by the light source 326, may be visible beyond the contact pad 380B, such as around and/or through the contact pad 380B.

The conductive tracing 300 is positioned with reference to the key 370B to illustrate operation in accordance with an embodiment of the present system as is the selected sectional view B-B of the conductive tracing 300. In this view, the downward force 390B is illustratively shown as acting on a center portion of the contact pod 380B as may occur if the user applies a downward force within a center portion of the key 370B. The downward force 390 operates to deform the contact pad 380B such that the conductive surface 385B is brought into electrical contact with the conductive paths 310, 312. In this way, the conductive surface 385B electrically couples the conductive paths 310, 312 and thereby, the user desired indication may be reliably provided in case of a centered key press. Naturally as may be readily appreciated, while FIGS. 3B and 3C illustrate two extreme examples of key depression, namely peripheral and centered depression of the key, depression of the key in other portions will operate similarly and reliably result in the desired indication.

Of course, it is to be appreciated that any one of the above embodiments or processes may be combined with one or more other embodiments or processes in accordance with the present system.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. In addition, the section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference signs in the claims do not limit their scope;
d) several "means" may be represented by the same item or hardware or software implemented structure or function;
e) any of the disclosed elements may be comprised of hardware portions (e.g., including discrete and integrated electronic circuitry), software portions (e.g., computer programming), and any combination thereof;
f) hardware portions may be comprised of one or both of analog and digital portions;
g) any of the disclosed devices or portions thereof may be combined together or separated into further portions unless specifically stated otherwise; and
h) no specific sequence of acts or steps is intended to be required unless specifically indicated.

The claimed invention is:

1. A key for an electronic keyboard, the key comprising:
a contact pad; and
a conductive tracing underlying the contact pad,
wherein the conductive tracing comprises a pair of electrically conductive paths that are electrically isolated from each other,
wherein the contact pad comprises a conductive surface that is configured to make electrical contact between the pair of electrically conductive paths when the contact pad is depressed,
wherein each of the pair of electrically conductive paths comprises a plurality of conductive surfaces electrically coupled together, wherein each of the plurality of conductive surfaces extend radially substantially between a center portion and a peripheral portion of the conductive tracing, wherein the center portion of the conductive tracing for each of the pair of electrically conductive paths extends along a substantially circular path between the plurality of conductive surfaces that extend radially, and wherein the substantially circular paths of the center portions are substantially concentrically centered around the center portions.

2. The key of claim 1, wherein each of the plurality of conductive surfaces has a length that substantially extends between corresponding inner and outer concentric circles substantially centered around the center portion, wherein the peripheral portion of the conductive tracing for each of the pair of electrically conductive paths extends along a substantially circular path between the plurality of conductive surfaces that extend radially, and wherein the substantially circular paths of the peripheral portions are substantially concentrically centered around the center portions.

3. The key of claim 1, comprising a centermost portion that is cutout to provide a light path through the key, wherein the light path extends from an underside of the key though one of the plurality of conductive surfaces.

4. The key of claim 3, comprising a light source positioned on the underside of the key, wherein the light source is further positioned to provide light through the light path and wherein the contact pad is formed to enable light from the light path to pass through the contact pad.

5. The key of claim 1, wherein an outer one of the pair of electrically conductive paths completely surrounds an outer periphery of an inner one of the pair of electrically conductive paths.

6. The key of claim 1, wherein the contact pad comprises a resilient bulbous membrane overlying the conductive tracing, wherein conductive surface is formed on an underside of the resilient bulbous membrane facing the conductive tracing.

7. The key of claim 1, wherein the conductive tracing is substantially symmetric about an axis that passes through the center portion and extends in a direction substantially parallel to a surface of the conductive tracing.

8. The key of claim 1, wherein each of the conductive surfaces of a first one of the pair of electrically conductive paths comprise substantially identically formed conductive surfaces, and wherein each of the conductive surfaces of a second one of the pair of electrically conductive paths comprise substantially identically formed conductive surfaces.

9. A conductive tracing for an electronic keyboard, the conductive tracing comprising:

a first electrically conductive path; and a second electrically conductive path, wherein the first and second electrically conductive paths are electrically isolated from each other, wherein each of the first and second electrically conductive paths comprises a plurality of conductive surfaces electrically coupled together, wherein each of the plurality of conductive surfaces extend radially substantially between a center portion and a peripheral portion of the conductive tracing, wherein the center portion of the conductive tracing for the first and second electrically conductive paths extends along a substantially circular path between the plurality of conductive surfaces that extend radially, and wherein the substantially circular paths of the center portions are substantially concentrically centered around the center portions.

10. The conductive tracing of claim 9, wherein each of the plurality of conductive surfaces has a length that substantially extends between corresponding inner and outer concentric circles substantially centered around the center portion, wherein the peripheral portion of the conductive tracing for the first and second electrically conductive paths extends along a substantially circular path between the plurality of conductive surfaces that extend radially, and wherein the substantially circular paths of the peripheral portions are substantially concentrically centered around the center portion.

11. The conductive tracing of claim 9, comprising a centermost portion that is cutout to provide a light path through the conductive tracing, wherein the light path extends from an underside of the conductive tracing though one of the first and second electrically conductive paths.

12. The conductive tracing of claim 11, comprising a light source positioned on the underside of the conductive tracing, wherein the light source is further positioned to provide light through the light path.

13. The conductive tracing of claim 9, wherein the first electrically conductive path completely surrounds an outer periphery of the second electrically conductive path.

14. The conductive tracing of claim 9, comprising a third electrically conductive path that is configured to make electrical contact between the first and second electrically conductive paths when the third electrically conductive path is depressed, wherein the third electrically conductive path is formed on an underside of a resilient bulbous membrane overlying at least a portion of the first and second electrically conductive paths.

15. The conductive tracing of claim 9, wherein the conductive tracing is substantially symmetric about an axis that passes through the center portion and extends in a direction substantially parallel to a surface of the conductive tracing.

16. The conductive tracing of claim 9, wherein each of the conductive surfaces of the first electrically conductive path comprise substantially identically formed conductive surfaces, and wherein each of the conductive surfaces of the second electrically conductive path comprise substantially identically formed conductive surfaces.

17. A method of forming a conductive tracing for an electronic keyboard, the method comprising the acts of:

forming a first electrically conductive path having a plurality of conductive surfaces electrically coupled together; and forming a second electrically conductive path having a plurality of conductive surfaces electrically coupled together, wherein the first and second electrically conductive paths are formed electrically isolated from each other, and wherein each of the plurality of conductive surfaces are formed extending radially substantially between a center portion and a peripheral portion of the conductive tracing, wherein the center portion of the conductive tracing for the first and second electrically conductive paths are formed to extend along a substantially circular path between the plurality of conductive surfaces that extend radially, and wherein the substantially circular paths of the center portions are formed substantially concentrically centered around the center portions.

18. The method of claim 17, wherein the acts of forming the first and second electrically conductive surfaces comprises the acts of forming each of the plurality of conductive surfaces to have a length that substantially extends between corresponding inner and outer concentric circles substantially centered around the center portion, wherein the peripheral portion of the conductive tracing for the first and second electrically conductive paths are formed to extend along a substantially circular path between the plurality of conductive surfaces that extend radially, and wherein the substantially circular paths of the peripheral portions are formed substantially concentrically centered around the center portion.

19. The method of claim 17, comprising an act of forming a centermost portion that is cutout to provide a light path through the conductive tracing, wherein the light path is formed to extend from an underside of the conductive tracing though one of the first and second electrically conductive paths.

20. The method of claim 19, comprising an act of providing a light source positioned on the underside of the conductive tracing, wherein the light source is further positioned to provide light through the light path.

21. The method of claim 17, wherein each of the plurality of conductive surfaces of at least one of the first and second electrically conductive paths are similarly formed.

22. The method of claim 17, wherein the first electrically conductive path completely surrounds an outer periphery of the second electrically conductive path.

23. The method of claim 17, comprising an act of forming a third electrically conductive path to make electrical contact between the first and second electrically conductive paths when the third electrically conductive path is depressed, wherein the third electrically conductive path is formed on an underside of a resilient bulbous membrane overlying at least a portion of the first and second electrically conductive paths.

24. The method of claim 17, wherein each of the conductive surfaces of the first electrically conductive path are substantially identically formed, and wherein each of the conductive surfaces of the second electrically conductive path comprise substantially identically formed conductive surfaces.

* * * * *

UNITED STATES PATENT AND TRADEMARK OFFICE

CERTIFICATE OF CORRECTION

PATENT NO. : 7,763,815 B2
APPLICATION NO. : 11/557127
DATED : July 27, 2010
INVENTOR(S) : Luong It is certified that error appears in the above-identified patent and that said Letters Patent is hereby corrected as shown below:

IN THE SPECIFICATION

In Column 3, Line 43, delete “213” and insert -- 215 --, therefor.

In Column 5, Line 41, delete “334” and insert -- 384 --, therefor.

In Column 5, Line 66, delete “pod” and insert -- pad --, therefor.

IN THE CLAIMS

In Column 7, Line 21, in Claim 3, delete “though” and insert -- through --, therefor.

In Column 8, Line 12, in Claim 11, delete “though” and insert -- through --, therefor.

In Column 9, Line 10, in Claim 19, delete “though” and insert -- through --, therefor.

Signed and Sealed this
Fifteenth Day of May, 2012

David J. Kappos

David J. Kappos
*Director of the United States Patent and Trademark Office*